US005145159A

United States Patent [19]

Vits

[11] Patent Number: 5,145,159

[45] Date of Patent: Sep. 8, 1992

[54] APPARATUS FOR CHANGING A STACK IN A SHEET DELIVERER

[75] Inventor: Hilmar Vits, Leichlingen, Fed. Rep. of Germany

[73] Assignee: Heidelberger Druckmaschinen AG, Heidelberg, Fed. Rep. of Germany

[21] Appl. No.: 726,874

[22] Filed: Jul. 8, 1991

[30] Foreign Application Priority Data

Jul. 7, 1990 [DE] Fed. Rep. of Germany ..... 4021676

[51] Int. Cl.[5] ..... B65H 41/00

[52] U.S. Cl. ..... 270/52; 270/39; 414/790.8

[58] Field of Search ..... 270/39, 52, 52.5; 414/788.8, 789.9, 790, 790.8, 796.1

[56] References Cited

U.S. PATENT DOCUMENTS

| | | | |
|---|---|---|---|
| 4,162,649 | 6/1979 | Thomton | 414/790.8 |
| 4,747,591 | 5/1988 | Beyer | 270/525 |
| 4,750,724 | 6/1988 | Herd | 270/39 |
| 4,765,790 | 8/1988 | Bessemann | 414/790.8 |
| 4,778,165 | 10/1988 | Buck | 270/39 |
| 4,842,572 | 6/1989 | Roth | 270/39 |
| 4,842,573 | 6/1989 | Peter | 270/39 |
| 4,878,659 | 11/1989 | Besemann | 414/790.8 |

FOREIGN PATENT DOCUMENTS

| | | | |
|---|---|---|---|
| 2751489 | 2/1979 | Fed. Rep. of Germany . | |
| 2942965A1 | 5/1981 | Fed. Rep. of Germany . | |
| 3619676A1 | 12/1987 | Fed. Rep. of Germany . | |
| 261771 | 10/1990 | Japan | 270/31 |

*Primary Examiner*—Edward K. Look
*Assistant Examiner*—Therese M. Newholm
*Attorney, Agent, or Firm*—Kenyon & Kenyon

[57] ABSTRACT

An apparatus changes a sheet stack 11, formed on a conveying element, in a sheet deliverer with continuous sheet supply. To divide the stack into a lower composite stack to be conveyed away and an upper smaller component stack, two pushers 17, 20 are provided, of which the first pusher 20 is an edge pusher having a cutting edge 22 which is directed at a perpendicular front edge 23 of the stack 11 and from which an air jet is delivered which lifts the stack corner, forming a gap for the introduction of the edge pusher 20. During the further advance of the edge pusher, the smaller stack is separated over its whole width from the rest of the stack, so that the second pusher 17, constructed as a surface pusher, can be inserted perpendicularly to the direction of advance of the edge pusher 20.

18 Claims, 3 Drawing Sheets

APPARATUS FOR CHANGING A STACK IN A SHEET DELIVERER

FIELD OF THE INVENTION

The present invention relates to apparatus for printing and, more particularly, to an apparatus for changing a sheet stack formed on a conveying element in a sheet deliverer with continuous sheet supply.

BACKGROUND INFORMATION

The increase in the printing speed of rotary offset machines and the cutting of a web of material into sheets even half the size of the printing-cylinder-generated surface make it necessary for the machine operators to change the stack manually so often as to have an adverse effect on the continuous supervision of the printing machine.

In a prior art sheet deliverer of the kind specified, for example, in DE-AS 27 51 489, therefore, a triangular pusher and a rectangular pusher are provided, which are inserted manually at the stack-end face to separate an upper portion of the stack. A parting line is first formed manually for the tip of the triangular pusher, which is inserted first, so as to facilitate its insertion and avoid damage to the front edges of the sheets.

To separate component layers from a stationary stack it is known from DE-OS 36 19 676 to arrange at one edge of the stack a sheet-turning device which, when a component layer is reached, forms a gap at the edge which facilitates the introduction of separating heads. The separating heads are disposed on carriages and can travel along the end face. According to that method, the separating heads can displace the component stack which they seize in relation to the subjacent stack. With this prior art method it is impossible to change the stack without interrupting the deposition of the sheets.

Lastly, an apparatus is known for changing a stack in a sheet deliverer from DE-OS 29 42 965, which comprises a rake which can be driven in the conveying direction of the sheets between the top side of the stack and the sheets to be deposited thereon. To enable this operation to be performed without damaging the sheets, the front side of the rake has blowing nozzles. However, such a device is unsuitable for separating already stacked sheets, merely because there is no guarantee that the individual tines of the rake will be introduced between the same sheets. Nor can the tines be introduced into the stack at the end face without damage. The air jets emerging from the tines are unable to form a clearly defined gap between the same sheets over the whole end face.

It is an object of the present invention, therefore, to provide an apparatus for changing a sheet stack formed on a conveying element in a sheet deliverer, by means of which a change can be made to the stack rapidly, without manual assistance, and without the risk of damage to the sheets.

SUMMARY OF THE INVENTION

This and other objects are achieved by the present invention which is directed to an apparatus for changing a stack of sheets, comprising a conveying member for conveying a stack of sheets, and a first separating member defining a separating edge for being driven into a corner of the stack between two sheets of the stack. The separating edge thus separates the stack into a first stack located on one side of the separating edge and a second stack located on the other side of the separating edge. An air unit directs at least one stream of air relative to at least one side of the separating edge for facilitating the separation of the sheets by the separating edge. A second separating member is driven between the first and second stacks for supporting the first stack to permit removal of the second stack by the conveying member.

In an apparatus of the present invention, the separating edge is driven into a front edge of the stack in a direction substantially transverse to the direction of conveyance of the sheets by the conveying member, and in a direction substantially perpendicular to the direction that the second separating member is driven into the stack. The conveying member also preferably lowers the second stack relative to the first stack to further separate the edges of the sheets of the two stacks relative to each other prior to driving the second separating member between the first and second stacks.

In another apparatus of the present invention, the air unit includes a first air nozzle for directing a jet of air at an acute angle relative to the separating edge, which is in turn deflected by the separating edge into the corner of the stack to separate the edges of the at least two sheets of the stack to facilitate penetration of the separating edge between the separated edges of the two sheets. The air unit preferably further includes a second air nozzle located on an opposite side of the separating edge relative to the first air nozzle. The second air nozzle directs a jet of air at an acute angle relative to the separating edge, which is in turn deflected by the separating edge into the corner of the stack to further facilitate separation of the edges of the at least two sheets of the stack for penetration of the separating edge between the separated edges of the two sheets.

In another apparatus of the present invention, the second separating member includes at least one third nozzle for directing a stream of air toward the sheets of the stack to facilitate penetration of the second separating member between the first and second stacks. The second separating member preferably includes a plurality of third nozzles spaced relative to each other adjacent to an edge of the second separating member. Each third nozzle directs a stream of air toward the sheets of the stack to facilitate penetration of the second separating member between the first and second stacks.

In another apparatus of the present invention, the second separating member is coupled by means of at least one telescopic member to an arm member, which is in turn pivotally coupled to a column member. The second separating member is pivoted from a first position into a second position for driving the second separating member between the first and second stacks, by pivoting the arm member relative to the column member. The second separating member is then driven between the first and second stacks by moving the telescopic member relative to the arm member.

One advantage of the apparatus of the present invention is that a reliable separation can be obtained inside a stack of sheets, since the separation starts not in the center of the front edge of the stack, but with air boosting at a corner of the stack. The stack can still readily be lifted at such a corner. The air-lubricated separating edge engaging with an edge of the stack operates more reliably than a triangular cutting edge engaging with the center of the front edge of the stack.

Other objects and advantages of the apparatus of the present invention will become apparent in view of the following detailed description and drawings.

BRIEF DESCRIPTION OF THE DRAWINGS

Embodiments of the present invention will now be explained in detail with reference to the drawings, wherein.

DETAILED DESCRIPTION

Figure 1:
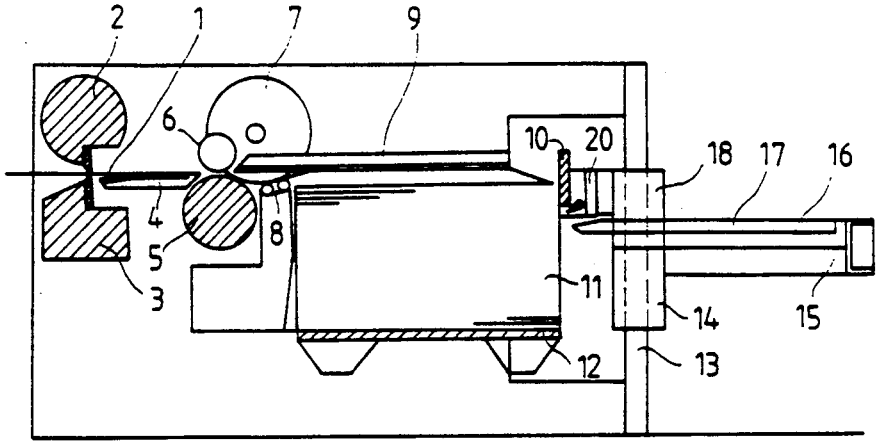
FIG. 1 is a vertical section through a sheet deliverer with crosscutter.
Figure 2:
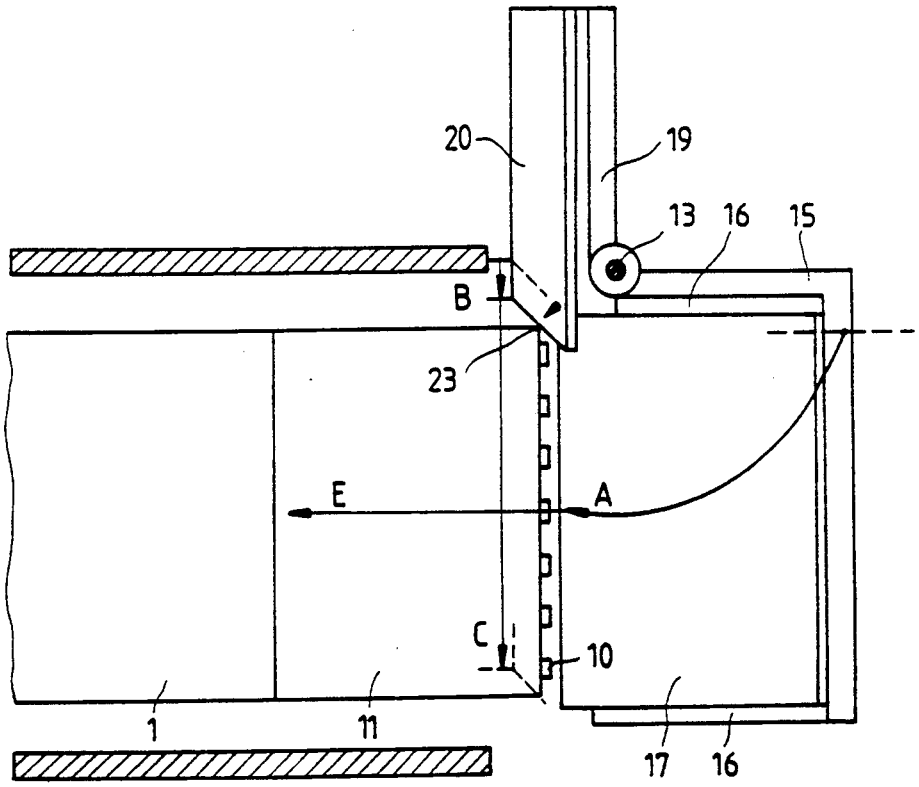
FIG. 2 is a plan view of the conveying plane of the sheet deliverer shown in FIG. 1.

Referring to the embodiment of the present invention shown in FIG. 1, a web of material 1 is subdivided by a crosscutter having an upper bladed roller 2 and a lower bladed beam 3, and is cut into sheets which are fed via a floating table 4 to a sheet deliverer. The sheet deliverer comprises a conveying roller 5, conveying rollers 6, cam discs 7, a suction table 8 for overlapping and deceleration, and a floating cover 9 below which the sheets are guided as far as a front edge stop 10, where they form a progressively rising stack 11 on a vertically adjustable pallet 12. Disposed outside the sheet alignment on a column 13 is a sleeve 14 having a bent supporting arm 15, on whose bent portion a flat pusher 17 is mounted in telescopic guides 16 on both sides, as shown in FIG. 2. Also on the sleeve 14 is another, unpivotable sleeve 18 having a single arm 19 having a telescopic guide for a front edge pusher 20, as also shown in FIG. 2.

Referring to FIG. 2, the flat pusher 17 is moved by a pivoting movement A of the supporting arm 15 around the column 13 into the operative position shown, which the edge pusher 20 reaches correspondingly by a small movement B.

Figure 3:
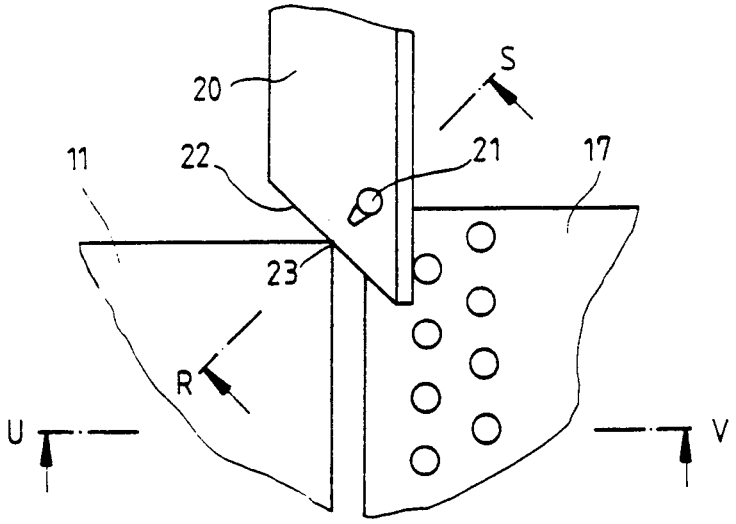
FIG. 3 shows in an enlarged scale a corner of a stack, formed in the sheet deliverer shown in FIG. 1, in the initial phase of the separation of the stack.
Figure 4:
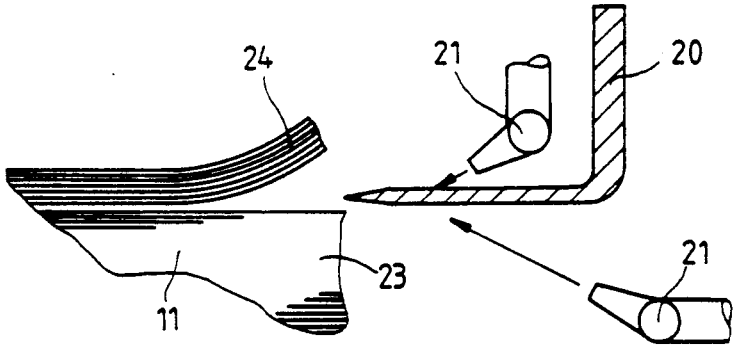
FIG. 4 is a section, taken along the line R-S in FIG. 3, through the corner of the stack shown in FIG. 3.

The stack change is initiated by a movement C of the edge pusher 20. The reliable separation required for this purpose is achieved by air lubrication. As shown in FIGS. 3 and 4, disposed above and below the edge pusher 20 are fixed air nozzles 21 which blow onto an inclined cutting edge 22 of the edge pusher 20, the resulting flat jet blows onto perpendicular stack edge 23 locally lifting a small upper portion of the stack 11 in the form of a group of sheets.

FIG. 4 is a view, taken along the line R-S in FIG. 3, showing how two round jets from the nozzles 21 form the flat jet upstream of the cutting edge 22 which lifts a small group of sheets 24 from the vertical stack edge 23.

Figure 5:
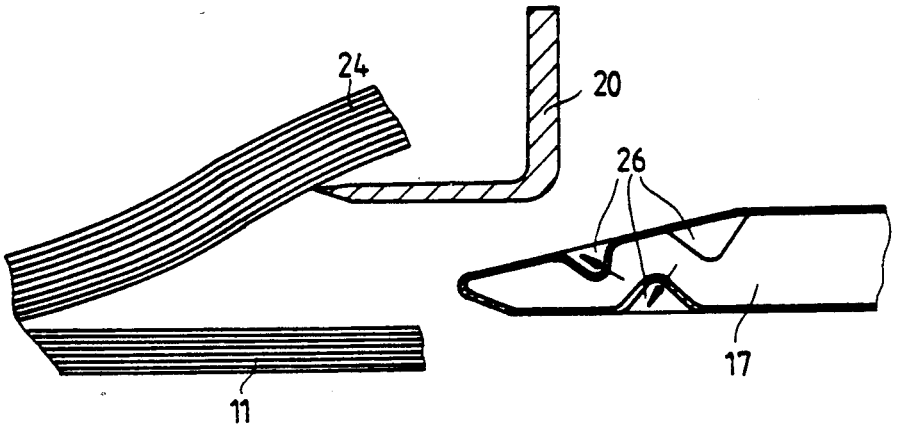
FIG. 5 is a section, taken along the line U-V in FIG. 3, of the corner of the stack shown in FIG. 3.
Figure 6:
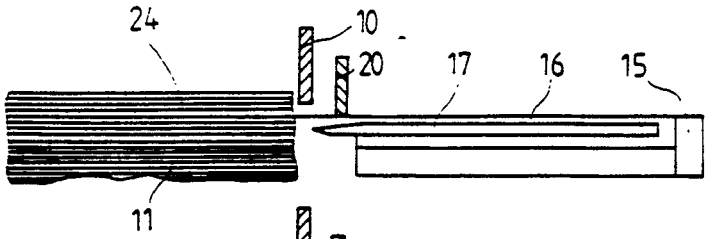
FIGS. 6 to 9 show different phases of the stack change.

The edge pusher 20 can then readily separate a small group of sheets 24 by the aforementioned movement C, as further illustrated in FIGS. 5 and 6.

Figure 7:
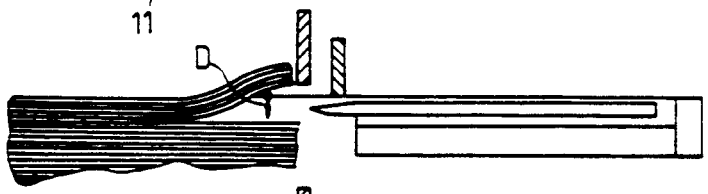

The stack 11 is then somewhat lowered, the result being a gap D, as shown in FIG. 7.

Figure 8:
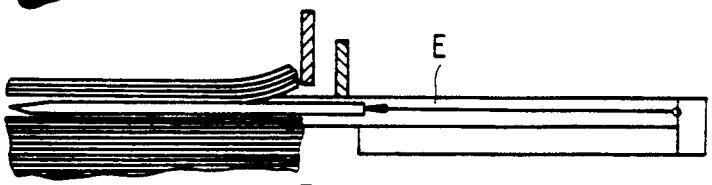

The flat pusher 17 is then inserted by the sheet length E, as shown in FIG. 8.

Figure 9:
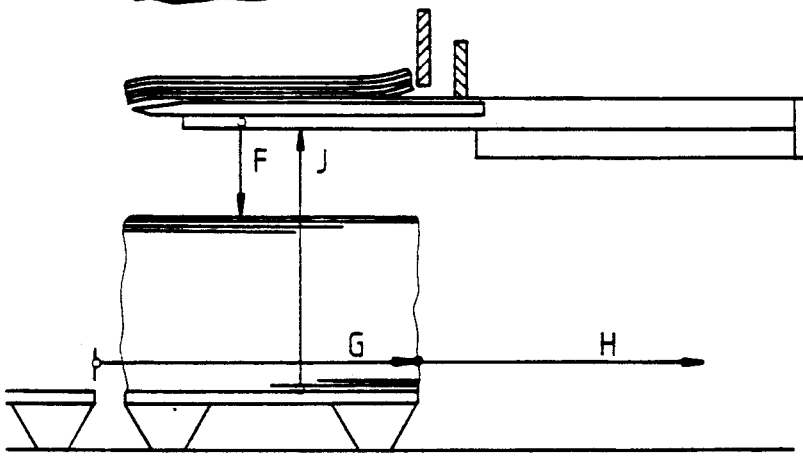

The pallet 12 with the stack 11 borne thereby is lowered as far as the bottom 25 by an amount F, and a fresh pallet **12*a* is pushed by an amount G into the position which the full pallet 12 leaves, as shown in FIG. 9**.

The fresh pallet **12*a* is then moved by a travel J under the flat pusher 17**.

These movements are performed in the converse sequence E, D, C, B, A, whereby the change of stack is completed and the full stack 11 on the pallet 12 can be conveyed away.

FIG. 5 shows how conical nozzles 26, for example, as disclosed in DE-OS 39 36 846, are provided in the front edge of the flat pusher 17 and blow an air cushion into the gap between the group of sheets 24 and the stack 11. The nozzles are arranged in two offset rows on the top and bottom sides of the flat pusher 17, as shown in FIG. 3.

Figure 10:
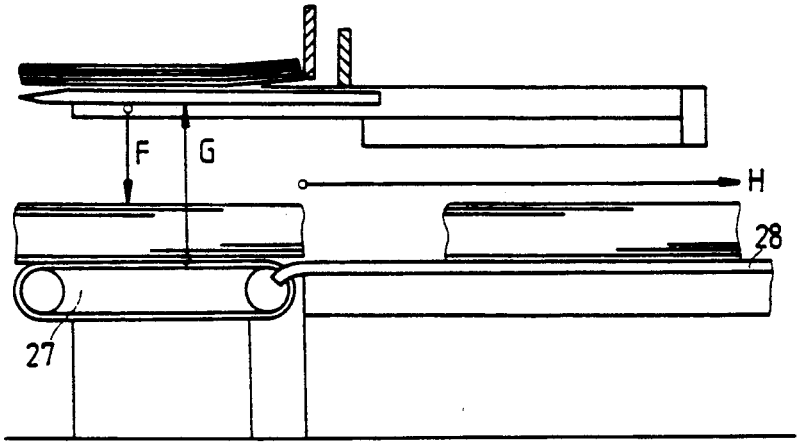
FIG. 10 shows a sheet deliverer having an alternative method of deposition from that shown in FIG. 1.

As shown in FIG. 10, instead of pallet operation, the stack 11 can also be formed, separated and removed on a vertically adjustable belt table 27, the height of the stack 11 being adapted to further processing, for example, to handling conveying on air cushion tables 28.

FIGS. 1 and 2 show the flat pusher in the introduction direction corresponding to the conveying direction. In the case of a two-web operation, two edge pushers each retain the outsides of the two stacks with the introduction direction against the conveying direction, while two flat pushers are advanced perpendicularly to the conveying direction from outside under the edge pushers and retain the two upper parts of the stack for the duration of stack removal. The pushers have telescopic guides on arms which are attached to sleeves. As is known for pallets, the sleeves are also furnished with an automatic lowering system. The stacks can therefore be formed, changed and removed without manual intervention.

I claim:

1. An apparatus for changing a stack of sheets, comprising:

a conveying member for conveying a stack of sheets;

a first separating member including a separating edge for being driven into a corner of the stack between two sheets of the stack for separating the stack into a first stack located on one side of the separating edge and a second stack located on the other side of the separating edge;

an air unit for directing at least one stream of air relative to at least one side of the separating edge for facilitating the separation of the sheets by the separating edge;

a second separating member for being driven between the first and second stacks for supporting the first stack to permit removal of the second stack by the conveying member; and wherein the separating edge is driven into a front edge of the stack in a direction substantially transverse to the direction of conveyance of the sheets by the conveying member, and in a direction substantially perpendicular to the direction that the second separating member is driven into the stack.

2. An apparatus as defined in claim 1, wherein the conveying member lowers the second stack relative to the first stack to further separate the edges of the sheets of the two stacks relative to each other prior to driving the second separating member between the first and second stacks.

3. An apparatus as defined in claim 1, wherein the air unit includes a first air nozzle for directing a jet of air at an acute angle relative to the separating edge which is in turn deflected by the separating edge into the corner of the stack to facilitate separation of the edges of at least two sheets of the stack for penetration of the separating edge between the separated edges of the two sheets.

4. An apparatus as defined in claim 3, wherein the air unit further includes a second air nozzle located on an opposite side of the separating edge relative to the first air nozzle for directing a jet of air at an acute angle relative to the separating edge which is in turn deflected by the separating edge into the corner of the stack to further facilitate separation of the edges of the at least two sheets of the stack for penetration of the separating edge between the separated edges of the two sheets.

5. An apparatus as defined in claim 1, wherein the second separating member includes at least one nozzle for directing a stream of air toward the sheets of the stack to facilitate penetration of the second separating member between the first and second stacks.

6. An apparatus as defined in claim 5, wherein the second separating member includes a plurality of nozzles spaced relative to each other adjacent to an edge of the second separating member, and each nozzle directs a stream of air toward the sheets of the stack to facilitate penetration of the second separating member between the first and second stacks.

7. An apparatus as defined in claim 1, wherein the second separating member is pivotally mounted relative to the conveying member for pivoting the second separating member from a first position into a second position for driving the second separating member between the first and second stacks.

8. An apparatus as defined in claim 7, wherein the second separating member is coupled by means of at least one telescopic member to an arm member which is in turn pivotally coupled to a column member, wherein the second separating member is pivoted from the first position to the second position by pivoting the arm member relative to the column member and is driven between the first and second stacks by moving the telescopic member relative to the arm member.

9. An apparatus as defined in claim 1, wherein the second separating member is automatically driven between the first and second stacks upon driving the separating edge of the first separating member between the two sheets of the stack.

10. An apparatus for conveying a stack of sheets in a sheet delivering device with a continuous sheet supply, comprising:

a first pushing member defining a cutting edge for being driven into a corner of the stack of sheets between the edges of two adjacent sheets of the stack for separating a small group of sheets on top of the stack and located on one side of the cutting edge from a larger group of sheets located on the other side of the cutting edge;

means for generating at least one stream of air directed adjacent to the cutting edge for facilitating penetration of the cutting edge between the edges of the two adjacent sheets;

a second pushing member for being driven relative to the first pushing member between the separated edges of the two adjacent sheets of the stack for separating the small group of sheets from the remainder of the stack to remove the remainder of the stack; and wherein the cutting edge is driven into a front edge of the stack in a direction substantially transverse to the direction of conveyance of the sheets by the conveying member, and in a direction substantially perpendicular to the direction that the second pushing member is driven into the stack.

11. An apparatus as defined in claim 10, further including a conveying member for moving the remainder of the stack relative to the small group of sheets to further separate the edges of the two adjacent sheets relative to each other prior to driving the second pushing member between the separated edges.

12. An apparatus as defined in claim 10, wherein the means for generating includes a first air nozzle for directing a jet of air onto the cutting edge, which is in turn deflected by the cutting edge into the corner of the stack to facilitate separating the edges of the two adjacent sheets for penetration of the cutting edge between the two sheets.

13. An apparatus as defined in claim 12, wherein the means for generating further includes a second air nozzle located on an opposite side of the cutting edge relative to the first air nozzle for directing a jet of air onto the cutting edge, which is in turn deflected by the cutting edge into the corner of the stack to further facilitate separation of the edges of the two adjacent sheets for penetration of the cutting edge between the two sheets.

14. An apparatus as defined in claim 10, wherein the second pushing member includes at least one nozzle for directing a stream of air toward the sheets of the stack to facilitate penetration of the second pushing member between the separated edges of the two adjacent sheets.

15. An apparatus as defined in claim 14, wherein the second pushing member includes a plurality of nozzles spaced relative to each other adjacent to an edge of the second pushing member, and each nozzle directs a stream of air toward the sheets of the stack to facilitate penetration of the second pushing member between the two adjacent sheets.

16. An apparatus as defined in claim 10, wherein the second pushing member is pivotally mounted for pivoting the second pushing member from a first position into a second position for driving the second pushing member relative to the first pushing member between the separated edges of the two adjacent sheets.

17. An apparatus as defined in claim 16, wherein the second pushing member is coupled by means at least one telescopic member to an arm member, which is in turn pivotally coupled to a column member, wherein the second pushing member is pivoted from the first position into the second position by pivoting the arm member, and is driven relative to the first pushing member between the separated edges of the two adjacent sheets by moving the telescopic member relative to the arm member.

18. An apparatus as defined in claim 10, wherein the second pushing member is automatically driven relative to the first pushing member between the separated edges of the two adjacent sheets upon driving the cutting edge of the first pushing member between the edges of the two adjacent sheets.

* * * * *